US009604819B2

(12) United States Patent
Kattainen et al.

(10) Patent No.: US 9,604,819 B2
(45) Date of Patent: Mar. 28, 2017

(54) ELEVATOR MONITORING ARRANGEMENT CONFIGURED TO MONITOR OPERATION OF A SAFETY DEVICE OF AN ELEVATOR, A CONTROLLER AND METHOD FOR PERFORMING SAME

(71) Applicants: Ari Kattainen, Hyvinkaa (FI); Pekka Hytti, Hyvinkaa (FI); Jyrki Laaksonheimo, Hyvinkaa (FI)

(72) Inventors: Ari Kattainen, Hyvinkaa (FI); Pekka Hytti, Hyvinkaa (FI); Jyrki Laaksonheimo, Hyvinkaa (FI)

(73) Assignee: Kone Corporation, Helsinki (FI)

( * ) Notice: Subject to any disclaimer, the term of this patent is extended or adjusted under 35 U.S.C. 154(b) by 430 days.

(21) Appl. No.: 14/220,375

(22) Filed: Mar. 20, 2014

(65) Prior Publication Data

US 2014/0202798 A1 Jul. 24, 2014

Related U.S. Application Data

(63) Continuation of application No. PCT/FI2012/050957, filed on Oct. 5, 2012.

(30) Foreign Application Priority Data

Oct. 7, 2011 (FI) ..... 20115983

(51) Int. Cl.
*B66B 1/34* (2006.01)
*B66B 5/00* (2006.01)

(52) U.S. Cl.
CPC ..... *B66B 5/0031* (2013.01)

(58) Field of Classification Search
CPC ..... B66B 5/0031
(Continued)

(56) References Cited

U.S. PATENT DOCUMENTS 3,973,648 A * 8/1976 Hummert ..... B66B 5/0006 187/393
4,512,442 A * 4/1985 Moore ..... B66B 5/0006 187/393

(Continued)

FOREIGN PATENT DOCUMENTS

CN 1340454 A 3/2002
CN 1802306 A 7/2006

(Continued)

OTHER PUBLICATIONS

Chinese Office Action dated May 18, 2015 issued in corresponding Chinese Application No. 201280059887.0.

(Continued)

*Primary Examiner* — Anthony Salata
(74) *Attorney, Agent, or Firm* — Harness, Dickey & Pierce, P.L.C.

(57) ABSTRACT

A monitoring arrangement including a drop-out safety device associated with an elevator; an elevator component in operational connection with the drop-out safety device of the elevator; a measuring device configured to generate measuring data associated with operation of the elevator component; and a monitoring unit configured to, record, in a memory, one or more limit values associated with the measuring data, receive the measuring data from the measuring device, compare the measuring data to the one or more limit values, and—determine that the operating safety of the drop-out safety device is endangered, if the measuring data deviates from the one or more limit values, and form a monitoring signal, if the monitoring unit determines that the operating safety of the drop-out safety device is endangered.

16 Claims, 5 Drawing Sheets

(58) Field of Classification Search
USPC ..... 187/247, 288, 289, 293, 391, 393
See application file for complete search history.

(56) References Cited

U.S. PATENT DOCUMENTS

| | | | | |
|---|---|---|---|---|
| 4,928,021 | A * | 5/1990 | Yonemoto | B66B 1/32 187/288 |
| 5,407,028 | A * | 4/1995 | Jamieson | B66B 5/10 187/287 |
| 5,557,546 | A * | 9/1996 | Fukai | B66B 5/0025 187/391 |
| 5,578,801 | A | 11/1996 | Hofmann | |
| 6,325,179 | B1 | 12/2001 | Barreiro et al. | |
| 7,350,883 | B2 * | 4/2008 | Hubbard | B66B 5/0018 187/393 |
| 7,617,911 | B2 * | 11/2009 | Mattila | B66B 5/0031 187/288 |
| 7,740,110 | B2 * | 6/2010 | Kattainen | B66B 1/32 187/288 |
| 8,207,700 | B2 * | 6/2012 | Syrman | H02P 3/26 187/288 |
| 8,272,482 | B2 * | 9/2012 | Takahashi | B66B 1/32 187/288 |
| 8,602,170 | B2 * | 12/2013 | Fischer | B66B 11/043 187/288 |
| 8,820,484 | B2 * | 9/2014 | Rui | B66B 1/32 187/288 |
| 2007/0000735 | A1 | 1/2007 | Hanninen | |
| 2009/0255764 | A1 | 10/2009 | Ueda et al. | |
| 2011/0198167 | A1 | 8/2011 | Huppunen et al. | |
| 2013/0213745 | A1 * | 8/2013 | Kattainen | H02P 3/02 187/288 |

FOREIGN PATENT DOCUMENTS

| | | | |
|---|---|---|---|
| CN | 1910103 | A | 2/2007 |
| CN | 102203452 | A | 9/2011 |
| EP | 1780160 | A1 | 5/2007 |
| WO | WO-00/20320 | A1 | 4/2000 |
| WO | WO-2005/066057 | A2 | 7/2005 |
| WO | WO-2010/061049 | A1 | 6/2010 |

OTHER PUBLICATIONS

Extended European Search Report dated May 11, 2015 issued in corresponding European Application No. 12838642.2.
International Search Report for PCT/FI2012/050957 dated Dec. 11, 2012.
Written Opinion for PCT/FI2012/050957 dated Dec. 11, 2012.
Finnish Search Report for FI20115983 dated Feb. 23, 2012.

* cited by examiner

ELEVATOR MONITORING ARRANGEMENT CONFIGURED TO MONITOR OPERATION OF A SAFETY DEVICE OF AN ELEVATOR, A CONTROLLER AND METHOD FOR PERFORMING SAME

This application is a continuation of PCT International Application No. PCT/FI2012/050957 which has an International filing date of Oct. 5, 2012, and which claims priority to Finnish patent application number 20115983 filed Oct. 7, 2011, the entire contents of both which are incorporated herein by reference.

FIELD OF THE INVENTION

The invention relates to solutions for monitoring the operation of a safety device of an elevator.

BACKGROUND OF THE INVENTION

An elevator comprises safety devices, the purpose of which is to prevent dangerous situations related to use of the elevator. This type of safety device is e.g. an electromagnetic brake of an elevator, such as the machinery brake of the hoisting machine of the elevator or a guide rail brake of an elevator car.

Activation of the brake occurs by dropping out the brake by disconnecting the current supply to the magnetizing coil of the electromagnet of the brake. The current traveling in the magnetizing coil decreases with a time constant, the magnitude of which is usually at least some hundreds of milliseconds. The time constant is determined on the basis of, inter alia, the inductance of the magnetizing coil. After the current has decreased sufficiently, the force of the thruster spring in the electromagnetic brake exceeds the force of attraction with which the electromagnet pulls the surfaces of the brake that are on opposite sides of the air gap against each other, after which the brake shoe of a machinery brake or the prong of a guide rail brake starts to move towards the braking surface on a rotating part of the hoisting machine or towards the braking surface on a guide rail of the elevator car. The brake activates when the brake shoe/prong strikes against the braking surface to brake the movement of the hoisting machine/elevator car.

Fast and correctly-timed operation of a brake is important for, inter alia, preventing the drifting of an elevator car away from the stopping floor, because an elevator car drifting away from the stopping floor might cause a shearing hazard for a passenger remaining between the elevator hoistway entrance and the elevator car.

By means of fast and correctly-timed operation of the brake it can also be ensured that the elevator car is not able to collide with the end buffer of the elevator hoistway at an excessive speed. Implementing this is extremely challenging in elevators having a reduced end buffer e.g. owing to shallow top clearances or bottom clearances of the elevator hoistway with respect to the run speed of the elevator car. In this case the brake of the elevator must be activated to brake the speed of an elevator car approaching the end of the elevator hoistway sufficiently early and at precisely the correct moment in order for the speed of the elevator car to have time to decrease to the permitted buffer collision speed before a possible collision with a reduced end buffer. A polyurethane buffer, inter alia, is used as a reduced end buffer, which polyurethane buffer has a rather limited shock absorbing capability and which is also damaged by the force of even a rather small impact.

The operation of the brake can be accelerated by adding a special quenching circuit to the breaker circuit of the current supply, via which quenching circuit the current of the magnetizing coil of the electromagnet of the brake travels during disconnection of the current supply. A quenching circuit comprises one or more components, such as resistors or capacitors, which component(s) receive(s) the energy stored in the inductance of the magnetizing coil while simultaneously accelerating disconnection of the current of the magnetizing coil.

Activation of the brake might be slowed down e.g. owing to failure of the quenching circuit. The activation function of the brake might also be slowed down or even completely prevented as a consequence of, inter alia, a failure of an electronic or electromechanical component of the brake control circuit or of a short-circuit occurring in the brake control circuit, or, for instance, as a consequence of an earth fault of the brake control circuit.

AIM OF THE INVENTION

The aim of the present invention is to solve the aforementioned problems as well as the problems relating to improving the safety of an elevator that are disclosed in the description of the invention below, by disclosing an improved solution for monitoring the operating capability of a drop-out safety device of an elevator. To achieve this aim the invention discloses a monitoring arrangement, according to claim 1, of an elevator and also a method, according to claim 15, for monitoring an elevator. The preferred embodiments of the invention are described in the dependent claims. Some inventive embodiments and also some inventive combinations of the various embodiments are also presented in the descriptive section and in the drawings of the present application.

SUMMARY OF THE INVENTION

The monitoring arrangement of an elevator according to the invention comprises a drop-out safety device of the elevator, an elevator component, which is in operational connection with the drop-out safety device of the elevator, a measuring device, with which the operation of the aforementioned elevator component is measured, and also a monitoring unit. The monitoring unit comprises an input for the measuring data of the aforementioned measuring device as well as a memory for setting one or more boundary conditions to be connected to the safe operation of the elevator component. The monitoring unit is configured to receive measuring data from the aforementioned measuring device and also to determine that the operating safety of the drop-out safety device of the elevator is endangered, if the measuring data received does not fulfill the boundary conditions set for the safe operation of the elevator component. When it determines that the operating safety of the drop-out safety device of the elevator is endangered, the monitoring unit is configured to form a monitoring signal for preventing a dangerous situation of the elevator. The measuring data does not fulfill the boundary conditions set for the safe operation of the elevator component e.g. when/if the measuring data received/some of the measuring data received is missing and/or the values, or at least some of the values, received by the measuring data deviate from the permitted values. In one preferred embodiment of the invention the aforementioned elevator component belongs to the drop-out apparatus with which a safety device of the elevator is dropped out.

In the invention operational connection of an elevator component to a drop-out safety device of the elevator means that a change in the operation of the elevator component causes a detectable change in the operation/response of the drop-out safety device and/or that a change in the operation of the drop-out safety device causes a detectable change in the operation/response of the elevator component. The invention enables improvement of the safety of an elevator by enhancing the efficiency of the monitoring of the operating capability of a safety device/safety devices of an elevator. The invention also enables the raising of the safety classification of present-day safety devices of an elevator, in which case an existing safety device/existing safety devices can be used in a new way or in a new context for ensuring the safety of an elevator. On the other hand, according to the invention it is also possible to take into use a completely new types of safety devices and/or safety arrangements of an elevator or to use those types of elevator components as safety devices of an elevator that have earlier only been used in connection with the normal functions of an elevator that are not safety-critical.

In the invention a drop-out safety device means the type of safety device that as a result of a drop-out procedure activates to ensure the safety of an elevator. A drop-out procedure is started if e.g. the safety circuit of the elevator has detected a dangerous situation or when some other event is detected that requires activation of a safety device for ensuring the safety of the elevator. In some cases also the control of the elevator can start a drop-out procedure; this type of control method can be necessary e.g. for testing the operating capability of a safety device of the elevator or otherwise when using a safety device of the elevator during normal operation of the elevator.

In a preferred embodiment of the invention the monitoring unit is configured to receive measuring data from the aforementioned measuring device in a drop-out situation of a safety device of the elevator. Consequently, by means of the invention the operating capability of a safety device/safety devices can be monitored in a drop-out situation of the safety device, which is often the most critical phase of all from the viewpoint of the operation of a safety device.

In one preferred embodiment of the invention the aforementioned elevator component is an electronic elevator component. In some embodiments the aforementioned elevator component is an electromechanical elevator component. In the invention, the term elevator component means an individual component, such as an electronic or electromechanical component; on the other hand, in the invention an elevator component can also mean a bounded functional entity formed from two or more components, such as from electronic and/or electromechanical components, such as e.g. a circuit card comprising electronic and/or electromechanical components, which circuit card can be treated as a single component in connection with, inter alia, servicing, installation and modernization of an elevator.

In one preferred embodiment of the invention one or more limit values commensurate with the measuring data of the aforementioned elevator component are recorded in the memory of the monitoring unit, which limit value(s) demarcate(s) a value plurality of permitted values for the measuring data, and the monitoring unit is configured to compare the received measuring data of the elevator component to the aforementioned value plurality of permitted values for measuring data and also to determine that the operating safety of a drop-out safety device of the elevator is endangered, if the value(s) of the received measuring data differ(s) from the value plurality of permitted values.

In one preferred embodiment of the invention the aforementioned safety device is an electromagnetic brake and the aforementioned elevator component is a brake control circuit.

In some embodiments the aforementioned safety device is an electrically activated overspeed governor and the elevator component is an activation circuit of an overspeed governor.

In one preferred embodiment of the invention the brake control circuit is configured for supplying current to the magnetizing coil of the electromagnetic brake of the elevator.

In one preferred embodiment of the invention the brake control circuit comprises a current quenching circuit for accelerating disconnection of the current of the magnetizing coil, and the monitoring unit is configured to determine the operating condition of the current quenching circuit.

In one preferred embodiment of the invention the aforementioned brake control circuit is configured for connection between a current source and the electromagnetic brake of an elevator. The monitoring arrangement comprises measuring means for measuring the fault current of the brake control circuit and also a limit value for the fault current of the brake control circuit. The monitoring unit is configured to compare the measuring data of the fault current being received from the aforementioned measuring means to the aforementioned limit value for fault current of the brake control circuit, and also to determine that the operating safety of a drop-out safety device of the elevator is endangered, if the magnitude of the measured fault current exceeds the magnitude of the aforementioned limit value for fault current.

In one preferred embodiment of the invention the monitoring arrangement is arranged to limit the operation of the elevator on the basis of a monitoring signal.

In one preferred embodiment of the invention the monitoring arrangement is arranged to prevent the next run of the elevator on the basis of a monitoring signal.

In one preferred embodiment of the invention the elevator comprises a safety circuit. In one preferred embodiment of the invention the safety circuit of the elevator comprises an input for receiving a monitoring signal. In a preferred embodiment of the invention the safety circuit of the elevator is configured to activate a machinery brake and also to disconnect the power supply to the elevator motor on the basis of a received monitoring signal.

In one preferred embodiment of the invention the drop-out of a safety device is arranged to be started on the basis of an activation signal for the safety device formed by the safety circuit of the elevator.

In one preferred embodiment of the invention the monitoring arrangement is configured to generate a defect notification on the basis of a monitoring signal.

In one preferred embodiment of the invention the monitoring arrangement is configured for sending a defect notification to a service center.

In the method according to the invention for monitoring an elevator, an elevator component is fitted into operational connection with a drop-out safety device of the elevator, one or more boundary conditions for safe operation are set for the elevator component, the operation of the elevator component is measured and also it is determined that the operating safety of the drop-out safety device of the elevator is endangered, if the measuring data does not fulfill the boundary conditions set for the safe operation of the elevator component.

In one preferred embodiment of the invention a safety device of the elevator is dropped out and the operation of an elevator component is measured in the drop-out situation of the safety device of the elevator.

In one preferred embodiment of the invention a monitoring signal is formed for preventing a dangerous situation of the elevator when determining that the operating safety of an elevator component is endangered.

The invention also relates to a method for monitoring the condition of the current quenching circuit of the magnetizing coil of an electromagnetic brake. In the method, one or more limit values are set to determine the permitted voltage range for the voltage over the current quenching circuit during a drop-out situation of the brake, the voltage over the current quenching circuit in a drop-out situation of the brake is measured, and it is deduced that the current quenching circuit has failed if the measured voltage deviates from the permitted voltage range.

The preceding summary, as well as the additional features and additional advantages of the invention presented below, will be better understood by the aid of the following description of some embodiments, said description not limiting the scope of application of the invention.

EMBODIMENT 1

Figure 1:
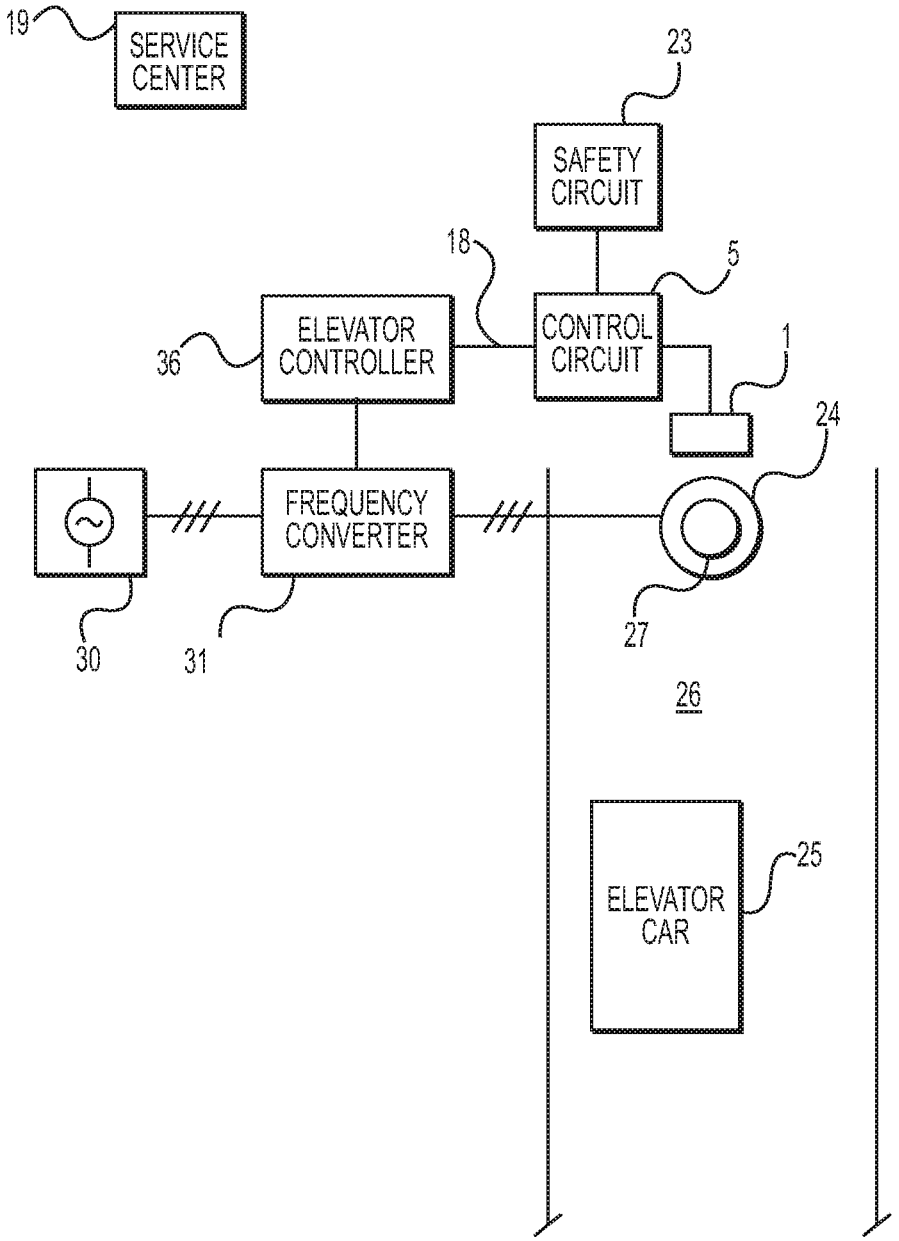
FIG. 1 presents as a block diagram an elevator system according to one embodiment of the invention

FIG. 1 presents as a block diagram an elevator system according to embodiment 1 of the invention, in which the elevator car 25 (and a counterweight, which as it is known per se in the art as a component of an elevator system is for the sake of simplicity not presented in FIG. 1) is suspended in the elevator hoistway 26 with elevator ropes, a belt or corresponding (the rope/belt is also not presented in FIG. 1 for the reason stated above) passing via the traction sheave 27 of the hoisting machine. In this embodiment of the invention the torque moving the elevator car 25 is produced with the permanent-magnet synchronous motor 24 of the hoisting machine, and the current supply to the permanent-magnet synchronous motor 24 occurs from the electricity network 30 with a frequency converter 31. The speed-regulating loop of the frequency converter 31 adjusts the speed of the traction sheave 27 of the hoisting machine, and thereby of the elevator car 25, towards the target value for speed calculated by the elevator control unit 36 by adjusting the flow of current/electric power of the elevator motor 24. The elevator control unit 36 forms the aforementioned target value for speed on the basis of elevator calls given by elevator passengers such that with the elevator it is possible to drive in the building from on floor to another in the manner required by the elevator calls.

Instead of a permanent-magnet motor, also e.g. a squirrel-cage motor or reluctance motor can be used as an elevator motor 24. On the other hand, the elevator system can also comprise separate ropes/belts for the suspension and for the driving of the elevator car 25. In one alternative embodiment of the invention, the elevator car and also the counterweight are suspended in the elevator hoistway with one or more ropes or belts, which travel via a diverting pulley fixed, in a manner allowing rotation, to the top part of the elevator hoistway. In addition to this, the elevator comprises one or more separate traction belts, preferably a toothed belt, which is fixed in connection with the elevator car and the counterweight and which travels via a traction sheave of a hoisting machine disposed in the bottom end zone of the elevator hoistway. The traction belt is tensioned to be taut so that the elevator car is driven with the elevator motor by rotating the traction sheave of the hoisting machine.

Figure 6:
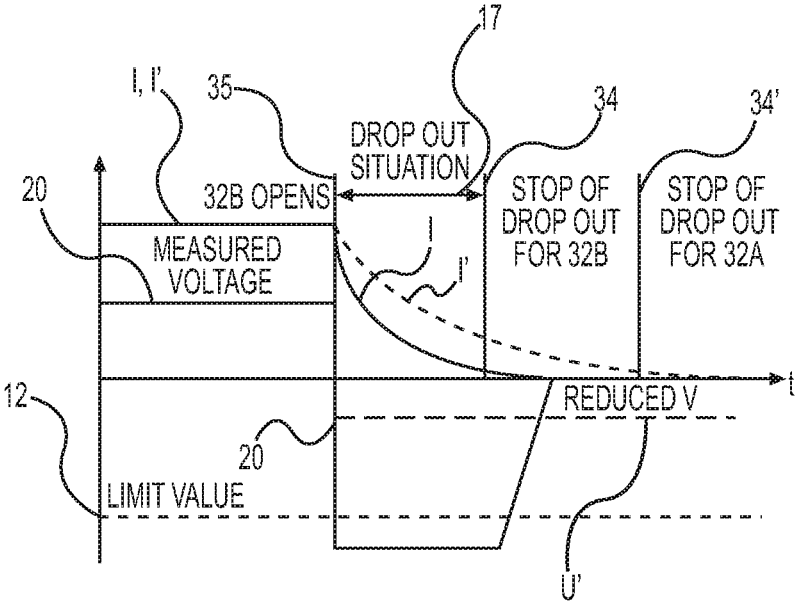
FIG. 6 illustrates the drop-out situation of a safety device of an elevator according to the invention More detailed description of preferred embodiments of the invention

According to the embodiment of FIG. 1 the hoisting machine of the elevator comprises an electromagnetic controllable brake 1 (usually a hoisting machine comprises at least two similar controllable brakes 1 that operate in the same manner). When the brake 1 is activated, the brake shoe is pressed against the braking surface on the traction sheave 27 of the hoisting machine, or on the shaft of the traction sheave, to brake the movement of the traction sheave 27. The brake 1 is controlled by supplying current via a control circuit 5 to the magnetizing coil of the electromagnet of the brake 1. The circuit diagram of the brake control circuit 5 to be used in the embodiment of FIG. 1 is presented in more detail in FIG. 4. FIG. 6, on the other hand, presents as a time chart the drop-out situation 17 of the brake 1 according to the embodiment of FIG. 1.

Activation of the brake 1 occurs by dropping out the brake 1 by disconnecting the current supply to the magnetizing coil 15 of the electromagnet of the brake. Disconnection of the current supply occurs by opening at least one of the two switches 32A, 32B in the brake control circuit 5. If the switch 32A is opened but the switch 32B is kept conductive, the current (I', FIG. 6) traveling in the magnetizing coil 15 decreases after the opening of the switch 32A with a time constant, the magnitude of which is usually at least some hundreds of milliseconds. The time constant is in this case essentially determined purely on the basis of the inductance and resistance of the magnetizing coil 15. After the current has decreased sufficiently, the force of the thruster spring in the brake 1 exceeds the force of attraction with which the electromagnet pulls the surfaces of the brake that are on opposite sides of the air gap of the magnetic circuit against each other. In this case the brake shoe of the brake 1 starts to move towards the aforementioned braking surface of the traction sheave 27/shaft of the traction sheave. The brake activates at the moment 34' when the brake shoe strikes against the braking surface to brake the movement of the hoisting machine/elevator car.

Figure 4:
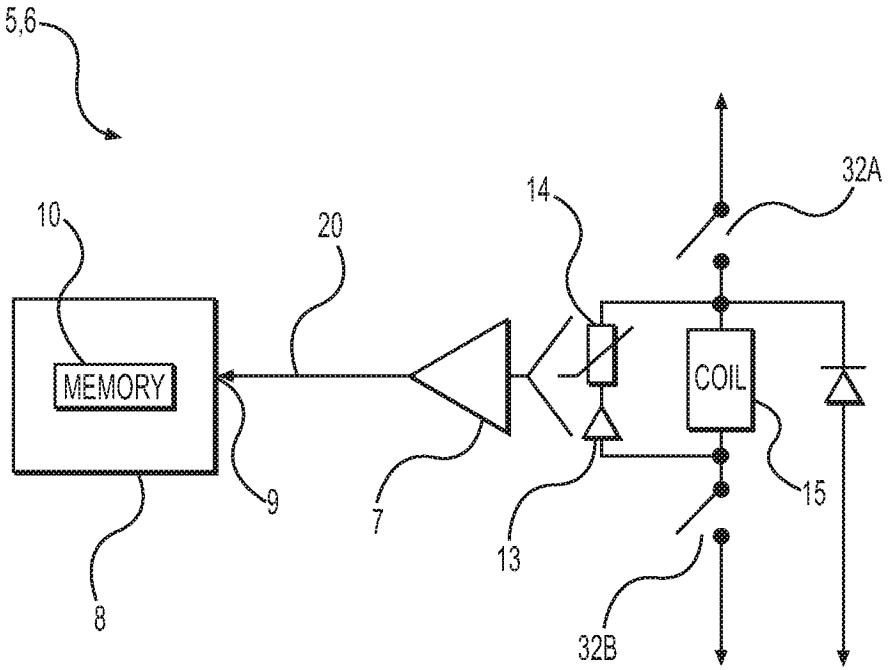
FIG. 4 presents as a circuit diagram a monitoring arrangement according to the invention

For accelerating the activation of the brake 1, in the brake control circuit 5 a current quenching circuit 13, 14 according to FIG. 4 is fitted in parallel with the magnetizing coil 15 of the brake, which current quenching circuit is, in this embodiment of the invention, formed from a series circuit of a varistor 14 and a diode 13, but which could also be formed in other ways; instead of a varistor, e.g. a resistor or capacitor could be used. When the switch 32B in the brake control circuit of FIG. 4 is opened, the current (I, FIG. 5) of the magnetizing coil 15 commutates to travel via the current quenching circuit 13, 14. In this case when current travels through the varistor 14, the varistor 14 starts to produce heat, thus changing the energy stored in the inductance of the magnetizing coil 15 into heat and in this way accelerating disconnection of the current of the magnetizing coil 15. The brake activates and the drop-out situation ceases at the moment 34, when the brake shoe strikes against the braking surface to brake the movement of the hoisting machine/elevator car. The aforementioned accelerated disconnection of the current of the magnetizing coil 15 and consequently activation of the brake that is as fast as possible is important for, inter alia, preventing various dangerous situations such as for preventing drifting of a moving elevator car 25 from a floor level when the landing door and car door are open, and also for preventing collision of the elevator car 25 into the end buffer of the elevator hoistway 26 at overspeed. Thus the elevator system of FIG. 1 is provided with a safety circuit 23, which when it detects a possible dangerous situation of the elevator controls open the switch 32B, in which case activation of the brake 1 occurs as quickly as possible. In addition, the safety circuit 23 disconnects the power supply occurring from the electricity network 30 to the elevator motor 24 by controlling open one or more of the IGBT transistors of the frequency converter 31, one or more of the contactors possibly in the power supply circuit of the elevator motor, et cetera.

Failure of the current quenching circuit 13, 14, such as a short-circuit of the varistor 14, results in the energy of the magnetizing coil 15 of the brake no longer being converted into heat in the current quenching circuit 13, 14 in the same way as earlier, and disconnection of the current of the magnetizing coil 15 slows down. At the same time activation of the brake 1 in connection with accelerated disconnection of the current also slows down.

Since correctly timed and rapid activation of the brake 1 is of essential importance from the viewpoint of the safety of the elevator, the elevator system of FIG. 1 is provided with a monitoring arrangement, with which the operating condition of the current quenching circuit 13, 14 is monitored in the manner presented in the following.

The operating condition of the current quenching circuit 13, 14 is monitored by measuring the voltage over the series circuit of the diode 13 and the varistor 14 with a test amplifier 7. A graph of the measured voltage 20 is illustrated in FIG. 6. At the moment 35, when the switch 32B opens and when the drop-out situation 17 of the brake simultaneously starts, the polarity of the voltage 20 changes and the current quenching circuit (mainly the varistor 14) starts to convert the energy stored in the magnetizing coil 15 of the brake into heat. Failure of the varistor 14 into a short-circuit can be detected as a reduction of the voltage over the series circuit of the diode 13 and the varistor 14; the reduced voltage resulting from failure of the varistor 14 is marked in FIG. 6 with the reference U'. The measured voltage 20 over the series circuit of the diode 13 and the varistor 14 is taken from the test amplifier 7 to the analog-to-digital converter of the microcontroller 8 of the brake control circuit, with which the voltage is sampled at short intervals of time during the drop-out situation 17 of the brake 1. A limit value 12 for the voltage 20 being measured is recorded in the memory of the microcontroller 8, and if the measured voltage 20 during the drop-out situation 17 of the brake 1 is of an absolute value that is smaller than the absolute value of the limit value 12, the microcontroller 8 deduces that the current quenching circuit 13, 14 has failed.

Since failure of the current quenching circuit 13, 14 means that the brake 1 will no longer activate as quickly as earlier, the microcontroller determines on the basis of the failure observation of the current quenching circuit 13, 14 that the operating safety of the brake 1 is endangered and forms a monitoring signal 18 relating to this for sending to the elevator control unit 36 and also to a service center 19 of the elevator via communication channels between the brake control circuit 5 and the elevator control unit 36/service center 19. The elevator control unit 36 takes into account the failure of the current quenching circuit 13, 14 by limiting the movement of the elevator car 25 in the elevator hoistway by reducing the maximum speed and/or the maximum acceleration/deceleration of the elevator car 25 and also by otherwise preventing operating situations that would require accelerated activation of the brake 1. Consequently, the elevator control unit 36 prevents, among other things, driving with the elevator when a landing door and car door are open, i.e. the advance opening function of the doors. The return of the elevator to a normal state requires that a serviceman visit the elevator, replacing the failed circuit card of the brake control circuit 5 with a new one.

In a second embodiment of the invention the software of the elevator control unit 36 switches into drive prevention mode after receiving a monitoring signal 18, in which case a normal run of the elevator is completely prevented and only service drive is permitted until the brake control circuit 5/current quenching circuit 13, 14 is/are repaired.

EMBODIMENT 2

Figure 2:
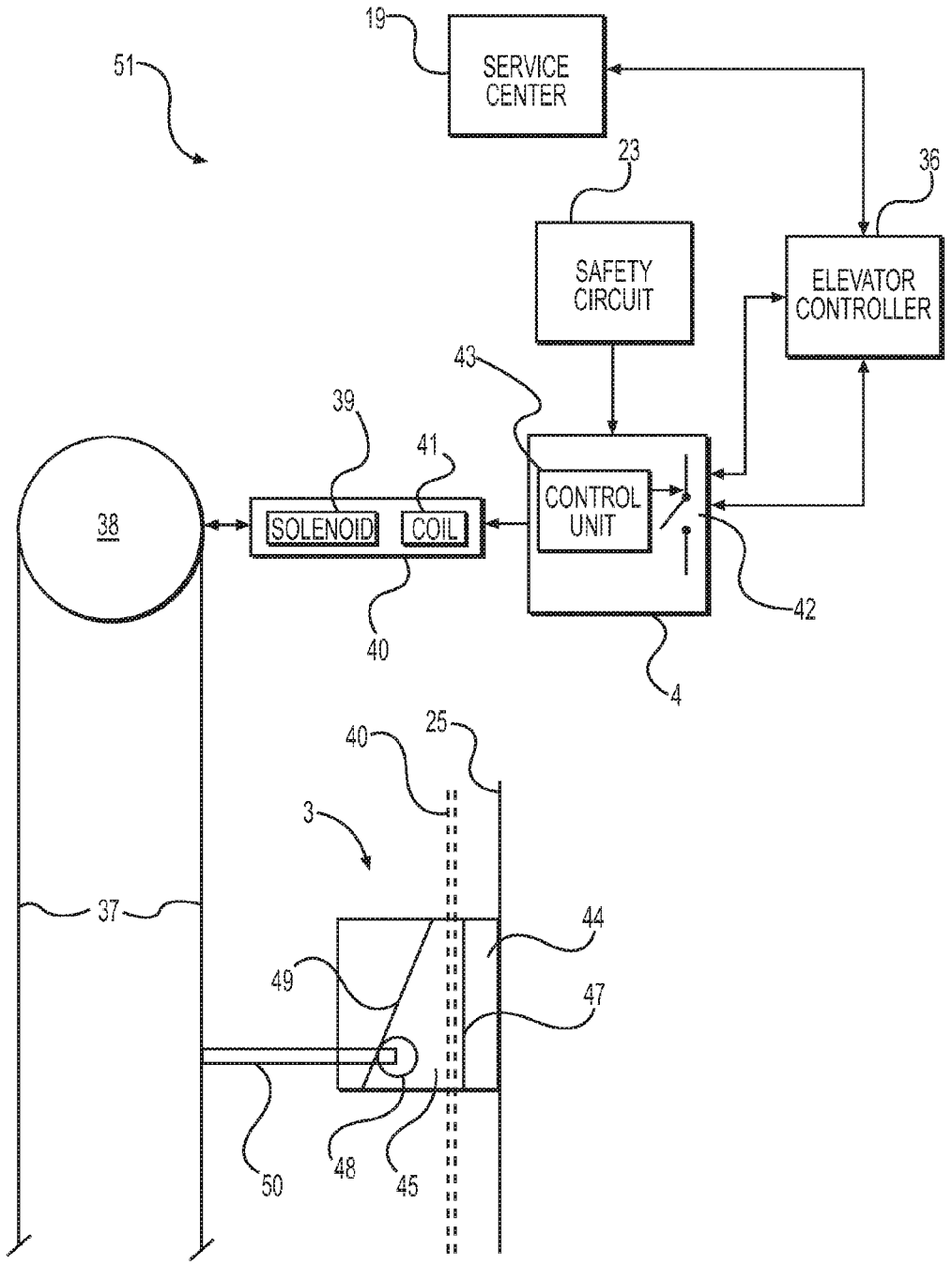
FIG. 2 presents as a block diagram an elevator system according to a second embodiment of the invention

The elevator system of FIG. 2 comprises as a safety device a safety gear 3 of the elevator car, with which safety gear the movement of the elevator car 25 is stopped in a dangerous situation, such as owing to adequately large overspeed of the elevator car 25, by gripping to the guide rail 46 of the elevator car. The frame part 44 of the safety gear 3 is fixed in connection with the elevator car 25 such that the frame part 44 moves along with the elevator car 25. The frame part 44 comprises a housing 45, which comprises a braking surface 47 towards the elevator guide rail 46, and inside which housing 45 the elevator guide rail 46 is disposed. Likewise, the housing 45 comprises a roller 48, which when the safety gear 3 operates meets the elevator guide rail 46 and is disposed on a track 49 in the housing 45. The elevator guide rail 46 is between the braking surface 47 and the roller 48. The track 49 is shaped such that when the roller 48 displaces on the track 49 in the direction of the guide rail 46, the guide rail 46 presses against the braking surface 47 under the effect of the roller 48 producing braking (gripping), which stops the elevator car 25. For example, the gripping of the elevator car 25 moving downwards as presented in FIG. 2 starts when the transmission means 50 that is in connection with the rope pulley 38 of the overspeed governor 51 of the elevator via the ropes 37 pulls the roller 48 of the safety gear 3 along the track 49 upwards to grip the guide rail 46. In practice this occurs by locking the movement of the rope pulley 38 when the elevator car 25 moves downwards, in which case the movement of the roller 48 decelerates with respect to the track 49 moving along with the elevator car 25 and the roller 48 displaces along the track 49 into the gripping position.

The overspeed governor 51 measures the speed of the elevator car 25 e.g. with an encoder fitted to the rope pulley 38 of the overspeed governor.

The overspeed governor 51 activates the safety gear 3 by locking the movement of the rope pulley 38 of the overspeed governor with a solenoid 39. The solenoid 39 is movably supported on a frame part 40, which is attached to a stationary part of the overspeed governor, so that movement of the rope pulley 38 is prevented by allowing the solenoid 39 to press onto the rope pulley 38. The solenoid 39 comprises pushing means, such as pusher springs, which press the solenoid 39 against the rope pulley 38. Detaching the solenoid 39, and keeping it detached from the rope pulley 38, requires that current is supplied to the coil 41 of the electromagnet of the solenoid 39, which current brings about an attractive force opposing the pushing force of the pushing means. The overspeed governor 51 is therefore configured to activate the gripping function always when the current supply to the coil 41 of the electromagnet of the solenoid is disconnected. The current supply to the coil 41 of the electromagnet of the solenoid occurs via the controllable switch 42 in the current supply circuit 4 of the coil 41 of the solenoid, so that the current supply to the coil 41 of the electromagnet of the solenoid is disconnected by opening the aforementioned controllable switch 42. The switch 42 is controlled open in response to a control formed by the safety circuit 23 of the elevator.

Failure of the current supply circuit 4 of the coil of the solenoid, such as failure of the switch 42 into a short-circuit, causes the current of the coil 41 of the solenoid to not disconnect and the gripping function does not in this case activate. For this reason the elevator system of FIG. 2 is provided with a monitoring arrangement, with which the operating condition of the switch 42 is monitored in the current supply circuit 4 of the coil of the solenoid. For monitoring the operating condition of the switch 42, the electronic control unit 43 of the overspeed governor 51 controls at set intervals the switch 42 to be conductive for a moment during a standstill of the elevator. The control unit 43 measures the voltage over the coil 41 of the solenoid both when the switch 42 is in the conductive state and also when the switch 42 has opened. If the voltage over the coil 41 of the solenoid in this case drops in a predefined manner when the switch 42 opens, the control unit 43 deduces that the switch 42 is in operable condition; otherwise the control unit 43 deduces that the switch has failed, determines on the basis of the failure observation of the switch 42 that the operating safety of the overspeed governor is endangered and forms a monitoring signal 18 relating to this for sending to the elevator control unit 36 and also to a service center 19 of the elevator. The software of the elevator control unit 36 switches into drive prevention mode after receiving a monitoring signal 18, in which use of the elevator is completely prevented until the switch 42 in the current supply circuit 4 of the coil 41 of the solenoid is repaired.

In one embodiment of the invention the monitoring arrangement of the safety gear of embodiment 2 is fitted into an elevator system according to the embodiment of FIG. 1.

EMBODIMENT 3

Figure 3:
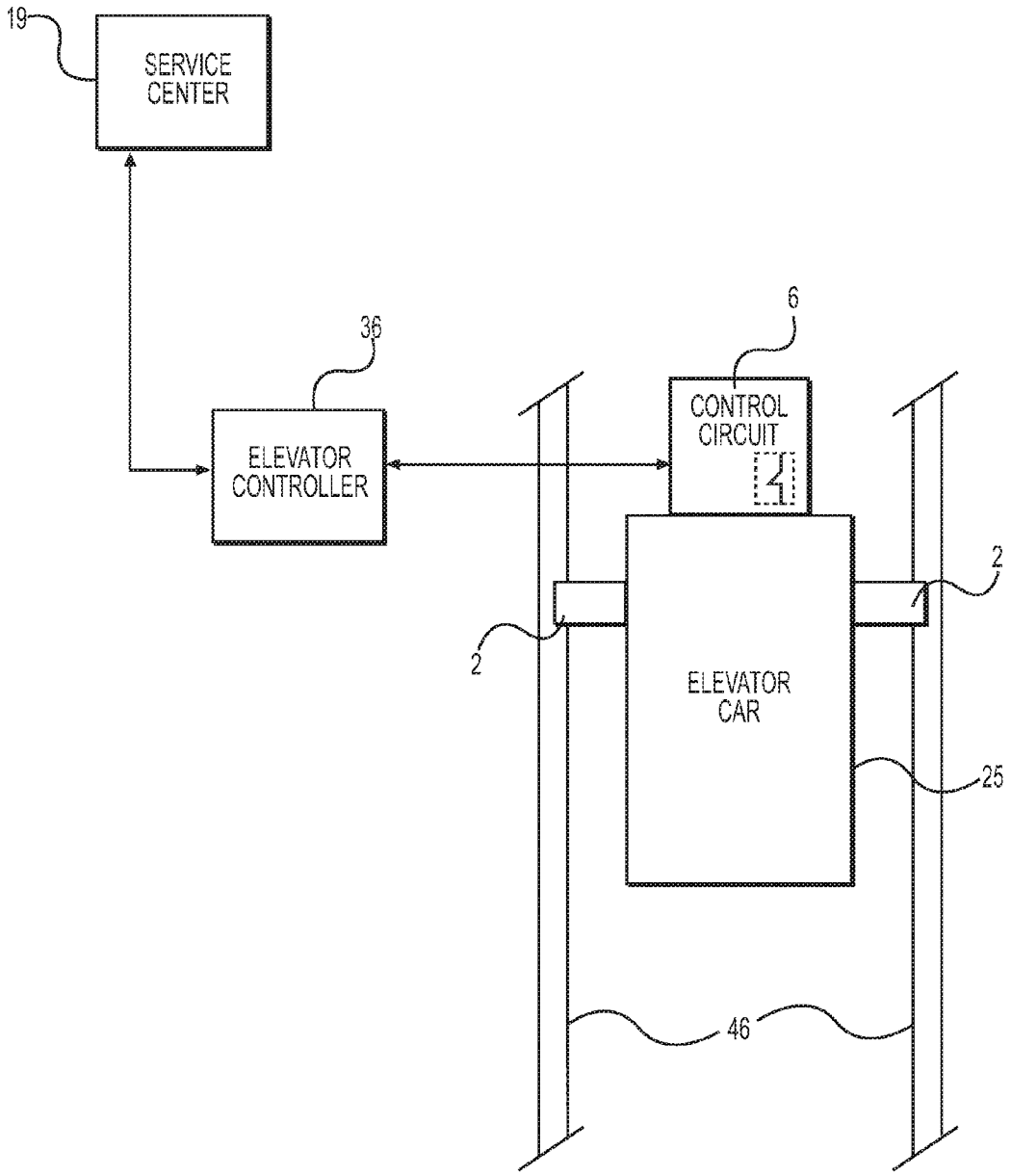
FIG. 3 presents as a block diagram an elevator system according to a third embodiment of the invention

In the elevator system of FIG. 3, an electromagnetic guide rail brake 2 is used as a safety device of the elevator, the frame part of which is fitted into connection with the elevator car 25. A guide rail brake/monitoring arrangement according to FIG. 3 can also be fitted into the elevator system described in embodiment 1 or 2. The guide rail brake 2 comprises a brake prong movably supported on the frame part, which when the brake activates grips the guide rail 46 on both of its sides to brake the movement of the elevator car 25. The control circuit 6 of the guide rail brake 2 and also the control principle are essentially similar to the control principle of the machinery brake 1 in the embodiment of FIG. 1. Consequently, the guide rail brake 2 is controlled by supplying current via the control circuit 6 of the guide rail brake to the magnetizing coil of the electromagnet of the guide rail brake 2. The guide rail brake 2 is open and the prongs are detached from the guide rail, when control current travels in the magnetizing coil of the electromagnet of the guide rail brake. The guide rail brake is dropped out by disconnecting the current supply of the magnetizing coil. The circuit diagram with current quenching circuit 13, 14 of the brake control circuit 6 to be used in the control of the guide rail brake 2 is also identical to the circuit diagram of the brake control circuit 5 of the machinery brake presented in FIG. 4; likewise the drop-out situation of the guide rail brake corresponds functionally to the drop-out situation 17 of the machinery brake 1 presented in FIG. 6. Consequently, the operating condition of the current quenching circuit 6 of the guide rail brake is also monitored in the same way as the operating condition of the current supply circuit 5 of the machinery brake in connection with the embodiment of FIG. 1, i.e. by measuring the voltage over the series circuit of the diode 13 and the varistor 14 with a test amplifier 7.

EMBODIMENT 4

Figure 5:
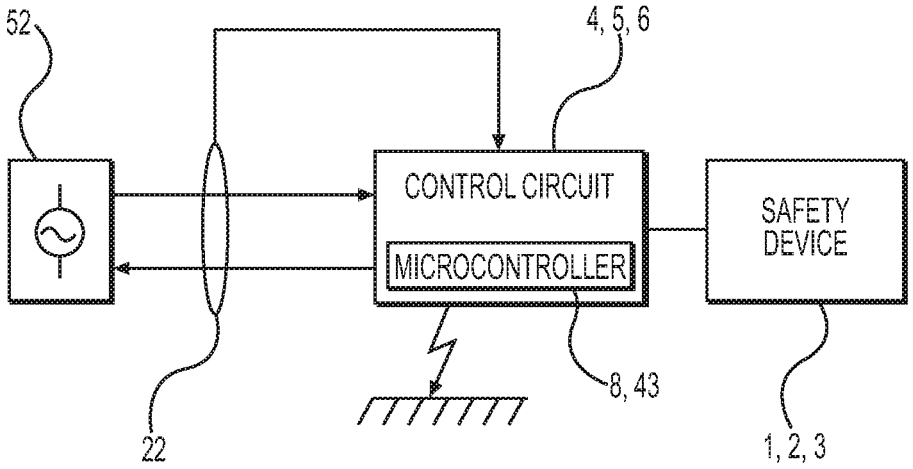
FIG. 5 presents as a circuit diagram a second monitoring arrangement according to the invention

In the monitoring arrangement presented in FIG. 5, the operating condition of a control circuit 5,6 of an electromagnetic brake 1, 2 according to embodiment 1-3 and/or of a current supply circuit 4 of a coil 41 of a solenoid of an overspeed governor is/are monitored as a precaution against an earth fault occurring in the control circuit 4, 5, 6 (hereinafter the collective designation "control circuit" is used for the control circuit 4,5/current supply circuit 4). Current-measuring means 22, such as one or more current transformers or Hall sensors, are fitted in connection with the electricity supply of the control circuit 4, 5, 6, with which means the difference between the magnitudes of the current being supplied from the current source 52 to the control circuit 4, 5, 6 and of the current returning back from the control circuit 4, 5, 6 to the current source 52 is measured. The difference in the magnitude of the current being supplied from the current source 52/the current returning back to the current source 52 expresses a fault current, i.e. the magnitude of the current traveling from the control circuit into the support structures et cetera, of the elevator in connection with an earth fault into a conductive part of the elevator system. The control unit 8, 43 of the control circuit reads the aforementioned difference between the current being supplied from the current source 52/the current returning back to the current source at regular intervals with an analog-to-digital converter and deduces an earth fault situation if the aforementioned difference between the currents exceeds the maximum permitted limit value recorded in the memory of the control unit 8, 43.

Owing to an earth fault situation of the control circuit 5, 6, the electromagnetic brake 1, 2 does not necessarily activate properly, on the other hand an earth fault situation of the current supply circuit 4 of the overspeed governor could also prevent operation of the overspeed governor/safety gear. Consequently, when it detects an earth fault situation of the control circuit 4, 5, 6, the control unit 8, 43 of the control circuit deduces that the operating safety of the electromagnetic brake/overspeed governor is endangered and forms a monitoring signal 18 for sending to the elevator control unit 36 and also to a service center 19 via communication channels between the control circuit 4, 5, 6 and the elevator control unit 36/service center 19. The software of the elevator control unit 36 switches into drive prevention mode after receiving a monitoring signal 18, such that use of the elevator is completely prevented until the earth fault situation in the control circuit 4, 5, 6 is rectified.

The invention is described above by the aid of a few examples of its embodiment. It is obvious to the person skilled in the art that the invention is not only limited to the embodiments described above, but that many other applications are possible within the scope of the inventive concept defined by the claims.

The invention claimed is:

1. A monitoring arrangement of an elevator, comprising:
a drop-out safety device associated with the elevator, the drop out safety device configured to limit movement of an elevator car associated with the elevator;
an elevator component in operational connection with the drop-out safety device of the elevator;
a measuring device configured to generate measuring data associated with operation of the elevator component; and
a monitoring unit configured to,
record, in a memory, one or more limit values associated with the measuring data,
receive the measuring data from the measuring device,
compare the measuring data to the one or more limit values, and
determine that operating safety of the drop-out safety device is endangered, if the measuring data deviates from the one or more limit values, and
transmit a monitoring signal to an elevator controller, if the monitoring unit determines that the operating safety of the drop-out safety device is endangered.

2. The monitoring arrangement according to claim 1, wherein the monitoring unit is configured to receive the measuring data from the measuring device such that the measuring data is associated with a drop-out situation of the safety device of the elevator.

3. The monitoring arrangement according to claim 1, wherein the elevator component is an electronic elevator component.

4. The monitoring arrangement according to claim 1, wherein
the memory is configured to store one or more limit values commensurate with the measuring data of the aforementioned elevator component, the one or more limit values indicating a plurality of permitted values for the measuring data, and
the monitoring unit is configured to,
compare the measuring data to the plurality of permitted values, and
determine that the operating safety of flail the drop-out safety device is endangered, if the measuring data deviates from the plurality of permitted values.

5. The monitoring arrangement according to claim 1, wherein the safety device is an electromagnetic brake and the elevator component is a brake control circuit.

6. The monitoring arrangement according to claim 5, wherein the brake control circuit is configured to supply current to a magnetizing coil of the electromagnetic brake of the elevator.

7. A monitoring arrangement of an elevator, comprising:
an electromagnetic brake associated with the elevator, the electromagnetic brake configured to limit movement of an elevator car associated with the elevator;
a brake control circuit configured to supply current to a magnetizing coil of the electromagnetic brake, the brake control circuit including a current quenching circuit configured to accelerate disconnection of the current of to the magnetizing coil;
a measuring device configured to generate measuring data associated with operation of the brake control circuit; and
a monitoring unit configured to,
record, in a memory, one or more limit values associated with the measuring data,
receive the measuring data from the measuring device,
compare the measuring data to the one or more limit values, and
determine that an operating condition of the current quenching circuit is endangered, if the measuring data deviates from the one or more limit values, and
transmit a monitoring signal to an elevator controller, if the monitoring unit determines that the operating condition of the electromagnetic brake is endangered.

8. A monitoring arrangement of an elevator, comprising:
an electromagnetic brake associated with the elevator, the electromagnetic brake configured to limit movement of an elevator car associated with the elevator;
a brake control circuit configured to supply current to a magnetizing coil of the electromagnetic brake, the brake control circuit being between a current source and the electromagnetic brake of the elevator;
a measuring device configured to measure a fault current of the brake control circuit to generate measuring data; and
a monitoring unit configured to,
compare the fault current to a limit value for the fault current of the brake control circuit stored in a memory, and
determine that operating safety of the drop-out safety device of the elevator is endangered, if a magnitude of the fault current exceeds the limit value for fault current, and
transmit a monitoring signal to an elevator controller, if the monitoring unit determines that the operating safety of the drop-out safety device of the elevator is endangered.

9. The monitoring arrangement according to claim 1, wherein the monitoring arrangement is configured to limit the operation of the elevator based on the monitoring signal.

10. The monitoring arrangement of an elevator according to claim 1, wherein the monitoring arrangement is configured to prevent a next run of the elevator based on the monitoring signal.

11. The monitoring arrangement according to claim 1, further comprising:
a safety circuit configured to receive the monitoring signal.

12. The monitoring arrangement according to claim 11, wherein the safety circuit of the elevator is configured to activate a machinery brake and disconnect a power supply to an elevator motor based on the monitoring signal.

13. The monitoring arrangement according to claim 1, wherein the monitoring arrangement is configured to generate a defect notification based on the monitoring signal.

14. The monitoring arrangement according to claim 13, wherein the monitoring arrangement is configured to send the defect notification to a service center.

15. A method for monitoring an elevator, the elevator including a drop out safety-device and an elevator component, the drop out safety-device configured to limit movement of an elevator car associated with the elevator, the method comprising:
setting one or more boundary conditions for safe operation of the elevator component;
activating the drop out safety-device of the elevator by dropping out the drop out safety-device;
measuring the operation of the elevator component when the activating drops out the drop-out safety-device; and transmitting a monitoring signal to an elevator controller, if the measuring data does not satisfy the one or more boundary conditions set for the safe operation of the elevator component.

16. A controller associated with an elevator, the controller comprising:

a memory and a processor, the memory containing computer readable code that, when executed, configures the processor to, record, in the memory, one or more limit values, receive measuring data from a measuring device, the measuring data being associated with operation of an elevator component, compare the measuring data to the one or more limit values, determine that operating safety of a drop-out safety device is endangered, if the measuring data deviates from the one or more limit values, the drop-out safety device configured to limit movement of an elevator car associated with the elevator, and transmit a monitoring signal to an elevator controller, if the controller determines that the operating safety of the drop-out safety device is endangered.

* * * * *